US011513456B2

(12) United States Patent
Takagi

(10) Patent No.: US 11,513,456 B2
(45) **Date of Patent: *Nov. 29, 2022**

(54) HEATER AND HEATING APPARATUS

(71) Applicant: TOSHIBA TEC KABUSHIKI KAISHA, Tokyo (JP)

(72) Inventor: Osamu Takagi, Chofu Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 98 days.

This patent is subject to a terminal disclaimer.

(21) Appl. No.: 17/088,505

(22) Filed: Nov. 3, 2020

(65) Prior Publication Data

US 2021/0048769 A1 Feb. 18, 2021

Related U.S. Application Data

(63) Continuation of application No. 16/700,599, filed on Dec. 2, 2019, now Pat. No. 10,859,954, which is a continuation of application No. 16/263,499, filed on Jan. 31, 2019, now Pat. No. 10,527,986, which is a continuation of application No. 15/621,670, filed on Jun. 13, 2017, now Pat. No. 10,228,642.

(30) Foreign Application Priority Data

Jun. 20, 2016 (JP) ..... 2016-121442
May 16, 2017 (JP) ..... 2017-096894

(51) Int. Cl.
*G03G 15/20* (2006.01)
*H05B 3/26* (2006.01)

(52) U.S. Cl.
CPC ..... *G03G 15/2053* (2013.01); *G03G 15/2039* (2013.01); *G03G 15/2042* (2013.01); *H05B 3/26* (2013.01); *G03G 2215/0132* (2013.01); *H05B 2203/005* (2013.01)

(58) Field of Classification Search
CPC ..... G03G 15/2039; G03G 15/2042; G03G 15/2053; G03G 2215/2022; H05B 3/26; H05B 2203/005; H05B 3/283
See application file for complete search history.

(56) References Cited

U.S. PATENT DOCUMENTS 5,171,969 A 12/1992 Nishimura et al.
6,090,305 A 7/2000 Balch et al.
(Continued)

FOREIGN PATENT DOCUMENTS

EP 2711778 A2 3/2014
JP H08-248792 A 9/1996
(Continued)

OTHER PUBLICATIONS

Extended European Search Report dated Nov. 16, 2017, filed in counterpart European Patent Application No. 17176299.0 (9 pages).
(Continued)

*Primary Examiner* — Benjamin R Schmitt
(74) *Attorney, Agent, or Firm* — Kim & Stewart LLP

(57) ABSTRACT

A heater includes a heat generating member in a first layer, a sensor that is in a second layer different from the first layer and configured to detect a temperature of the heat generating member, and a wiring pattern in one or more third layers between the first and second layers to supply power to the heat generating member.

20 Claims, 10 Drawing Sheets

(56) References Cited

U.S. PATENT DOCUMENTS

| | | | |
|---|---|---|---|
| 9,235,166 | B2 | 1/2016 | Shimura |
| 9,261,832 | B2 | 2/2016 | Muramatsu et al. |
| 2011/0062140 | A1 | 3/2011 | Sakakibara |
| 2014/0076878 | A1 | 3/2014 | Shimura |
| 2014/0138372 | A1 | 5/2014 | Ogura |
| 2015/0037052 | A1 | 2/2015 | Muramatsu et al. |
| 2016/0070216 | A1 | 3/2016 | Shimura |
| 2017/0003632 | A1 | 1/2017 | Jensen et al. |
| 2017/0102650 | A1 | 4/2017 | Shimura et al. |

FOREIGN PATENT DOCUMENTS

| | | | |
|---|---|---|---|
| JP | 2629980 | | 7/1997 |
| JP | 2008-107761 | A | 5/2008 |
| JP | 2015-028531 | | 2/2015 |
| WO | 2015141217 | A1 | 9/2015 |

OTHER PUBLICATIONS

Notice of Reasons for Refusal dated Mar. 2, 2021 in corresponding Japanese Patent Application No. 2017-096894, 8 pages (with Translation).

HEATER AND HEATING APPARATUS

CROSS-REFERENCE TO RELATED APPLICATION

This application is a continuation of U.S. patent application Ser. No. 16/700,599, filed on Dec. 2, 2019, which application is a continuation of U.S. patent application Ser. No. 16/263,499, filed on Jan. 31, 2019, now U.S. Pat. No. 10,527,986, issued on Jan. 7, 2020, which application is a continuation of U.S. patent application Ser. No. 15/621,670, filed on Jun. 13, 2017, now U.S. Pat. No. 10,228,642, issued on Mar. 12, 2019, which application is based upon and claims the benefit of priority from the prior Japanese Patent Application No. 2016-121442, filed on Jun. 20, 2016, and Japanese Patent Application No. 2017-096894, filed on May 16, 2017, the entire contents all of which are incorporated herein by reference.

FIELD

Embodiments described herein relate generally to a heater and a heating apparatus.

BACKGROUND

In a fixing apparatus in the past, a sheet is heated by a heater. However, the temperature of the heater in a portion where the sheet does not pass excessively rises. Therefore, problems such as a warp of the heater, deterioration of a fixing belt, and speed unevenness due to expansion of a conveying roller sometimes occur. It is undesirable from the viewpoint of energy saving to heat the portion where the sheet does not pass. Therefore, it is an important technical subject from the viewpoint of environmentally to intensively heat only a portion where the sheet passes.

Further, necessary to provide a temperature sensor to grasp a heat generation state of a heating roller and perform temperature control. However, to perform accurate temperature control, necessary to perform wiring in a state in which a circuit for power feed to the heater and the temperature sensor are completely insulated from each other.

DETAILED DESCRIPTION

Figure 1:
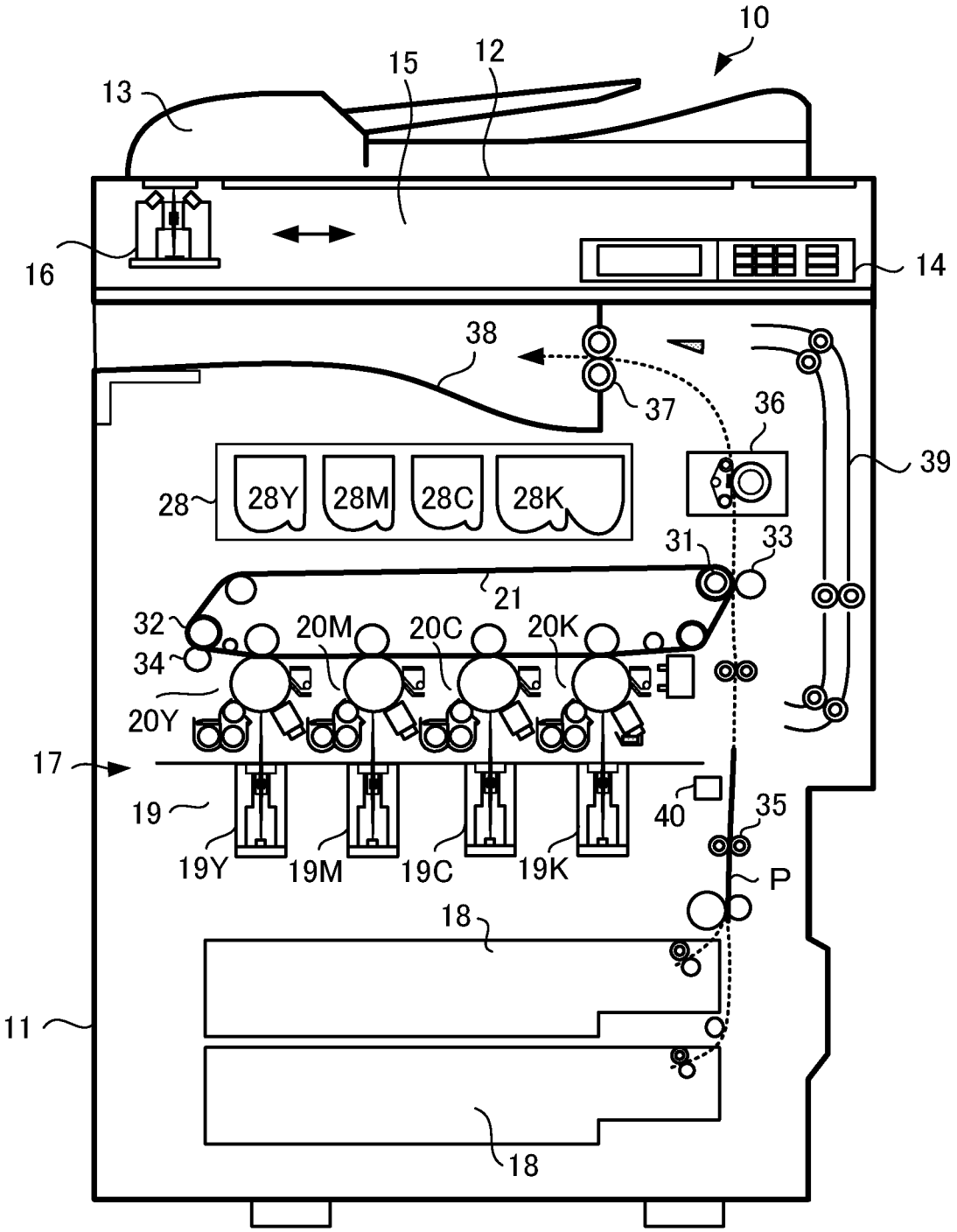
FIG. 1 is a configuration diagram showing an image forming apparatus including a fixing apparatus according to a first embodiment.

According to one embodiment, a heater includes a heat generating member in a first layer, a sensor that is in a second layer different from the first layer and configured to detect a temperature of the heat generating member, and a wiring pattern in one or more third layers between the first and second layers to supply power to the heat generating member.

An embodiment is explained below with reference to the drawings. Note that, in the figures, the same portions are denoted by the same reference numerals and signs.

First Embodiment

FIG. 1 is a configuration diagram showing an image forming apparatus including a heater and a fixing apparatus (a heating apparatus) according to a first embodiment. In FIG. 1, an image forming apparatus 10 is, for example, an MFP (Multi-Function Peripherals), which is a compound machine, a printer, or a copying machine. In the following explanation, the MFP is explained as an example.

A document table 12 of transparent glass is present in an upper part of a main body 11 of the MFP 10. An automatic document feeder (ADF) 13 is provided on the document table 12 to be capable of opening and closing. An operation unit 14 is provided in an upper part of the main body 11. The operation unit 14 includes an operation panel including various keys and a display device of a touch panel type.

A scanner unit 15, which is a reading device, is provided below the ADF 13 in the main body 11. The scanner unit 15 reads an original document fed by the ADF 13 or an original document placed on the document table 12 and generates image data. The scanner unit 15 includes a contact-type image sensor 16 (hereinafter simply referred to as image sensor). The image sensor 16 is disposed in a main scanning direction.

If the image sensor 16 reads an image of the original document placed on the document table 12, the image sensor 16 reads a document image line by line while moving along the document table 12. The image sensor 16 executes the line-by-line reading over the entire document size to read the original document for one page. If the image sensor 16 reads an image of the original document fed by the ADF 13, the image sensor 16 is present in a fixed position (a position shown in the figure). Note that the main scanning direction is a direction orthogonal to a moving direction of the image sensor 16 moving along the document table 12 (in FIG. 1, the depth direction).

Further, the MFP 10 includes a printer unit 17 in the center in the main body 11. The printer unit 17 processes image data read by the scanner unit 15 or image data created by a personal computer or the like to form an image on a recording medium (e.g., a sheet). The MFP 10 includes, in a lower part of the main body 11, a plurality of paper feeding cassettes 18 that store sheets of various sizes. Note that, as the recording medium on which an image is formed, there are an OHP sheet and the like besides the sheet. However, in an example explained below, an image is formed on the sheet.

The printer unit 17 includes a photoconductive drum and, as exposing devices a scanning head 19 including LEDs. The printer unit 17 scans the photoconductive drums with rays from the scanning head 19 and generates images. The printer unit 17 is, for example, a color laser printer by a tandem type. The printer unit 17 includes image forming units 20Y, 20M, 20C, and 20K of respective colors of yellow (Y), magenta (M), cyan (C), and black (K).

The image forming units 20Y, 20M, 20C, and 20K are disposed in parallel from an upstream side to a downstream side on a lower side of an intermediate transfer belt 21. The scanning head 19 includes a plurality of scanning heads 19Y, 19M, 19C, and 19K corresponding to the image forming units 20Y, 20M, 20C, and 20K.

Figure 2:
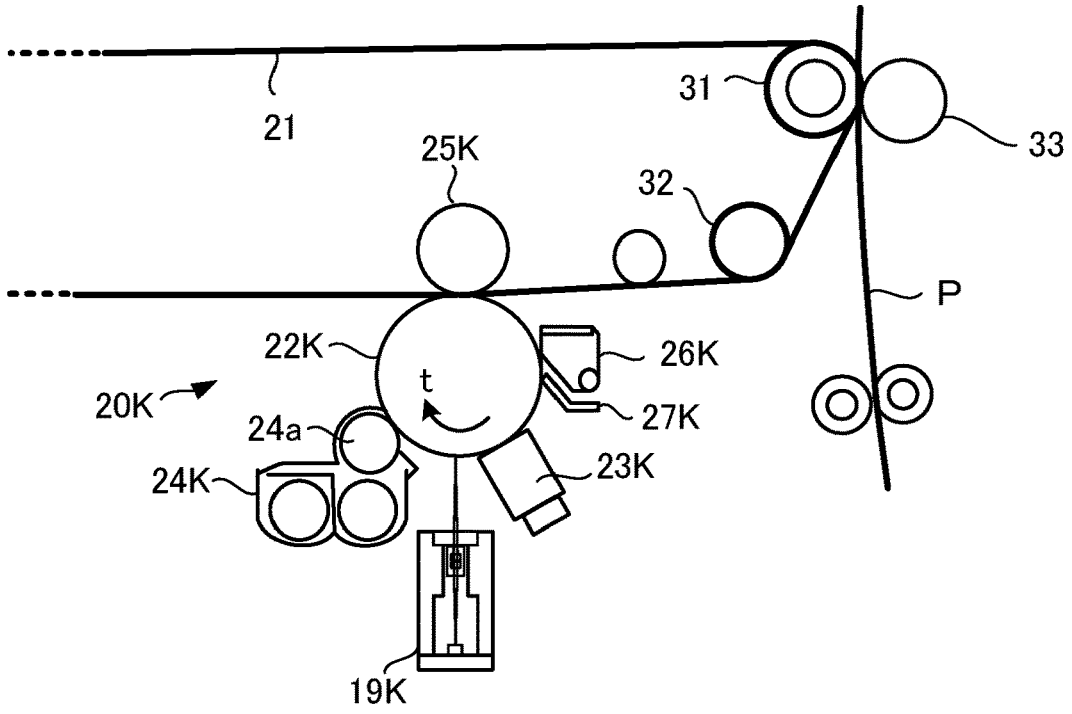
FIG. 2 is an enlarged configuration diagram of a part of an image forming unit in the first embodiment.

FIG. 2 is an enlarged configuration diagram of the image forming unit 20K among the image forming units 20Y, 20M, 20C, and 20K. Note that, in the following explanation, the image forming units 20Y, 20M, 20C, and 20K have the same configuration. Therefore, the image forming unit 20K is explained as an example.

The image forming unit 20K includes a photoconductive drum 22K, which is an image bearing body. An electrifying charger (a charging device) 23K, a developing device 24K, a primary transfer roller (a transfer device) 25K, a cleaner 26K, a blade 27K, and the like are disposed along a rotating direction t around the photoconductive drum 22K. Light is irradiated on an exposure position of the photoconductive drum 22K from the scanning head 19K to form an electrostatic latent image on the photoconductive drum 22K.

The electrifying charger 23K of the image forming unit 20K uniformly charges the surface of the photoconductive drum 22K. The developing device 24K supplies, with a developing roller 24*a* to which a developing bias is applied, a black toner to the photoconductive drum 22K and performs development of the electrostatic latent image. The cleaner 26K removes a residual toner on the surface of the photoconductive drum 22K using the blade 27K.

As shown in FIG. 1, a toner cartridge 28 that supplies toners to developing devices 24Y to 24K is provided above the image forming units 20Y to 20K. The toner cartridge 28 includes toner cartridges 28Y, 28M, 28C, and 28K of the colors of yellow (Y), magenta (M), cyan (C), and black (K).

The intermediate transfer belt 21 is stretched and suspended by a driving roller 31 and a driven roller 32 and moves in a cyclical manner. The intermediate transfer belt 21 is opposed to and in contact with photoconductive drums 22Y to 22K. A primary transfer voltage is applied to a position of the intermediate transfer belt 21 opposed to the photoconductive drum 22K by the primary transfer roller 25K. A toner image on the photoconductive drum 22K is primarily transferred onto the intermediate transfer belt 21 by the application of the primary transfer voltage.

A secondary transfer roller 33 is disposed to be opposed to the driving roller 31 that stretches and suspends the intermediate transfer belt 21. If a sheet P passes between the driving roller 31 and the secondary transfer roller 33, a secondary transfer voltage is applied to the sheet P by the secondary transfer roller 33. The toner image on the intermediate transfer belt 21 is secondarily transferred onto the sheet P. A belt cleaner 34 is provided near the driven roller 32 in the intermediate transfer belt 21.

As shown in FIG. 1, paper feeding rollers 35 are provided between the paper feeding cassettes 18 and the secondary transfer roller 33. The paper feeding rollers 35 convey the sheet P extracted from the paper feeding cassettes 18. Further, a fixing apparatus 36, which is a heating apparatus, is provided downstream of the secondary transfer roller 33. A conveying roller 37 is provided downstream of the fixing apparatus 36. The conveying roller 37 discharges the sheet P to a paper discharge section 38.

Further, a reversal conveying path 39 is provided downstream of the fixing apparatus 36. The reversal conveying path 39 reverses the sheet P and guides the sheet P in the direction of the secondary transfer roller 33. The reversal conveying path 39 is used if duplex printing is performed.

FIGS. 1 and 2 show an example of the embodiment. However, the structures of image forming apparatus portions other than the fixing apparatus 36 are not limited to the example shown in FIGS. 1 and 2. The structure of a publicly-known electrophotographic image forming apparatus can be used.

Figure 3:
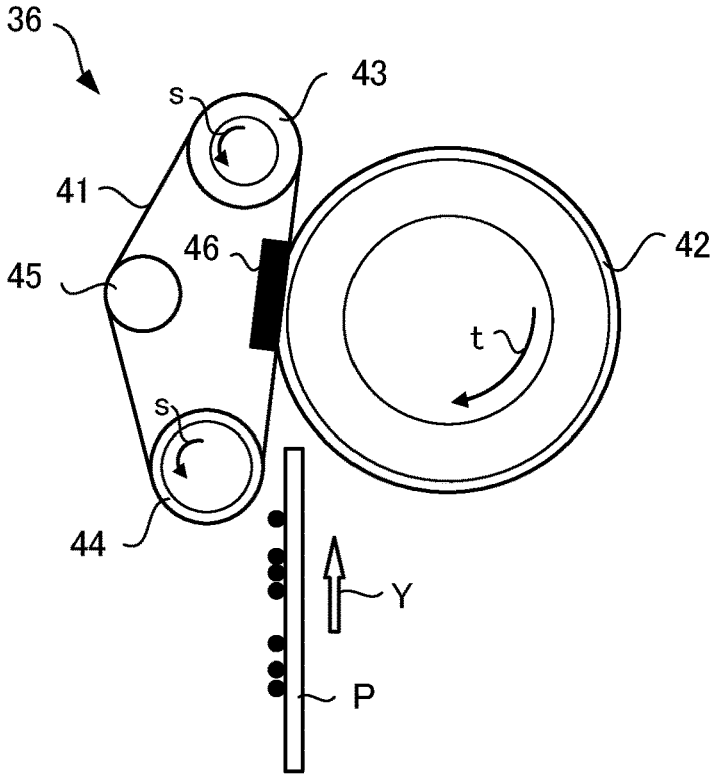
FIG. 3 is a configuration diagram showing an example of the fixing apparatus according to the first embodiment.

FIG. 3 is a configuration diagram showing an example of the fixing apparatus 36, which is the heating apparatus. The fixing apparatus 36 includes a fixing belt (an endless belt) 41, which is an endless rotating body, a press roller 42, which is a pressurizing body, belt conveying rollers 43 and 44, and a tension roller 45. The fixing belt 41 is an endless belt on which an elastic layer is formed. The fixing belt 41 is rotatably stretched and suspended by the belt conveying rollers 43 and 44 and the tension roller 45. The tension roller 45 applies predetermined tension to the fixing belt 41.

A tabular heating member (a heater) 46 is provided between the belt conveying rollers 43 and 44 on the inner side of the fixing belt 41. The heating member 46 is in contact with the inner side of the fixing belt 41. The heating member 46 is disposed to be opposed to the press roller 42 via the fixing belt 41. The heating member 46 is pressed in the direction of the press roller 42 and forms a fixing nip having a predetermined width between the fixing belt 41 and the press roller 42.

If the sheet P passes the fixing nip, a toner image on the sheet P is fixed on the sheet P with heat and pressure. A driving force is transmitted to the press roller 42 by a motor and the press roller 42 rotates (a rotating direction is indicated by an arrow t in FIG. 3). The fixing belt 41, the belt conveying rollers 43 and 44, and the tension roller 45 rotate following the rotation of the press roller 42 (a rotating direction of the fixing belt 41, the belt conveying rollers 43 and 44, and the tension roller 45 is indicated by an arrow s shown in FIG. 3).

In the fixing belt 41, which is the rotating body, a silicon rubber layer (an elastic layer) having thickness of 200 μm is formed, for example, on the outer side on a SUS or nickel substrate having thickness of 50 μm or polyimide, which is heat resistant resin having thickness of 70 μm. The outermost circumferential surface of the fixing belt 41 is covered by a surface protecting layer of PFA or the like. In the press roller 42, which is the pressurizing body, for example, a silicon sponge layer having thickness of 5 mm is formed on the surface of an iron bar of ϕ10 mm. The outermost circumference of the press roller 42 is covered by a surface protecting layer of PFA or the like. A detailed configuration of the heating member 46 is explained below.

Figure 4:
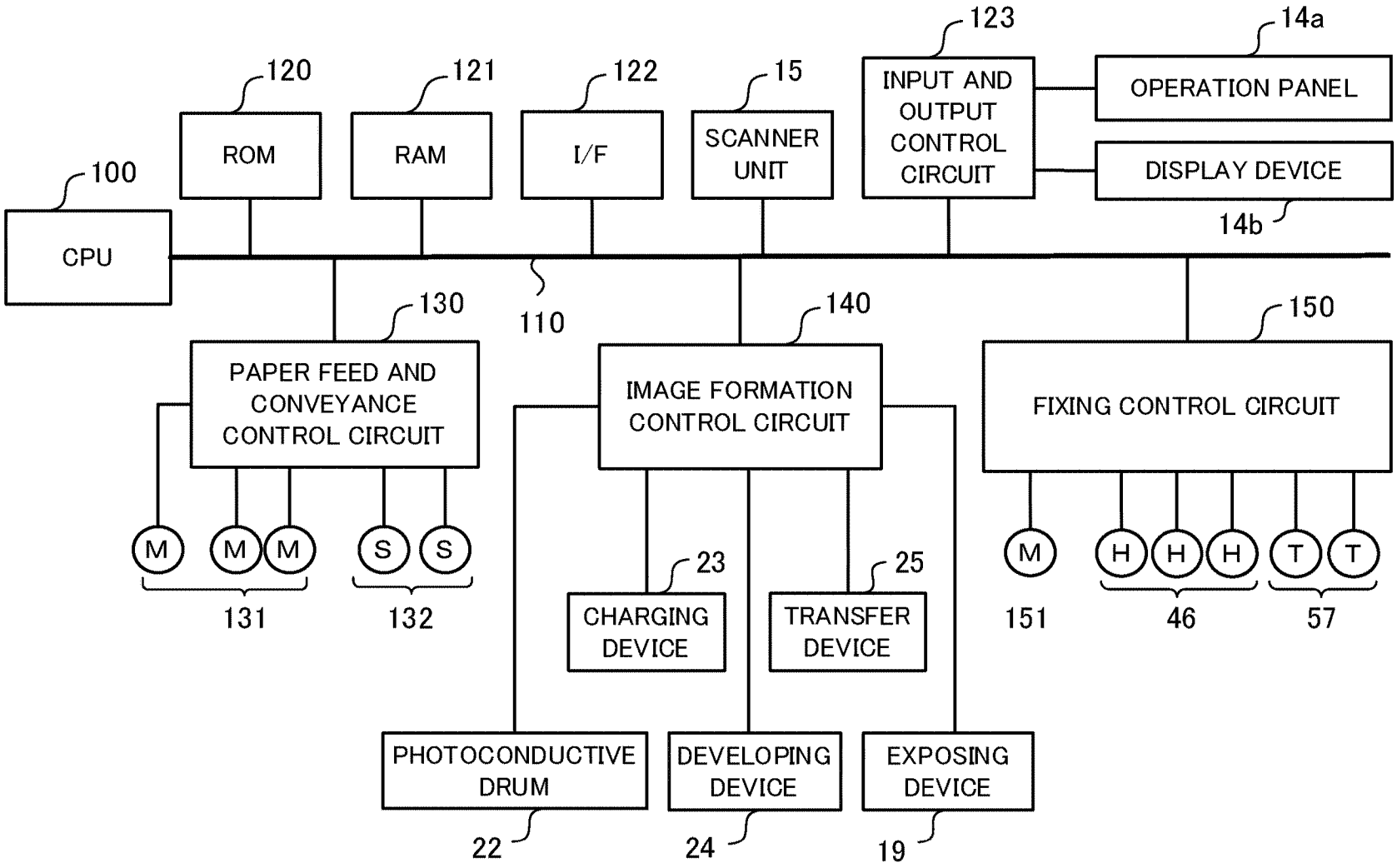
FIG. 4 is a block diagram showing a control system of an MFP in the first embodiment.

FIG. 4 is a block diagram showing a configuration example of a control system of the MFP 10 in the first embodiment. The control system includes, for example, a CPU 100, a bus line 110, a read only memory (ROM) 120, a random access memory (RAM) 121, and an interface (I/F)

122. The control system includes the scanner unit 15, an input and output control circuit 123, a paper feed and conveyance control circuit 130, an image formation control circuit 140, and a fixing control circuit 150. The CPU 100 and the circuits are connected via the bus line 110.

The CPU 100 controls the entire MFP 10. The CPU 100 realizes a processing function for image formation by executing a computer program stored in the ROM 120 or the RAM 121. The ROM 120 stores a control program, control data, and the like for controlling a basic operation of image formation processing. The RAM 121 is a working memory.

The ROM 120 (or the RAM 121) stores, for example, control programs for the image forming unit 20, the fixing apparatus 36, and the like and various control data used by the control programs. Specific examples of the control data in this embodiment include a correspondence relation between the size (the width in the main scanning direction) of a printing region in a sheet and a heat generating member to be energized.

A fixing temperature control program of the fixing apparatus 36 includes a determination logic for determining the size of an image forming region in a sheet on which a toner image is formed. The fixing temperature control program includes a heating control logic for selecting a switching element of a heat generating member corresponding to a position where the image forming region passes and energizing the switching element before the sheet is conveyed into the inside of the fixing apparatus 36 and controlling heating in the heating member 46.

The I/F 122 performs communication with various apparatuses such as a user terminal and a facsimile. The input and output control circuit 123 controls an operation panel 14*a* and a display device 14*b*. An operator can designate, for example, a sheet size and the number of copies of an original document by operating the operation panel 14*a*.

The paper feed and conveyance control circuit 130 controls a motor group 131 and the like that drive the paper feeding rollers 35, the conveying roller 37 in a conveying path, or the like. The paper feed and conveyance control circuit 130 controls the motor group 131 and the like on the basis of control signals from the CPU 100 according to detection results of various sensors 132 near the paper feeding cassettes 18 or on the conveying path.

The image formation control circuit 140 controls the photoconductive drum 22, the charging device 23, the exposing device 19 (correspond to the scanning head 19), the developing device 24, and the transfer device 25 respectively on the basis of control signals from the CPU 100.

The fixing control circuit 150 controls, on the basis of a control signal from the CPU 100, a driving motor 151 that rotates the press roller 42 of the fixing apparatus 36. The fixing control circuit 150 controls energization to a heat generating member (explained below) of the heating member 46. The fixing control circuit 150 inputs temperature information of the heating member 46 detected by temperature sensors 57 and controls the temperature of the heating member 46. Note that, in this embodiment, the control program and the control data of the fixing apparatus 36 are stored in a storage device of the MFP 10 and executed by the CPU 100. However, an arithmetic operation device and a storage device may be separately provided exclusively for the fixing apparatus 36.

Figure 5:
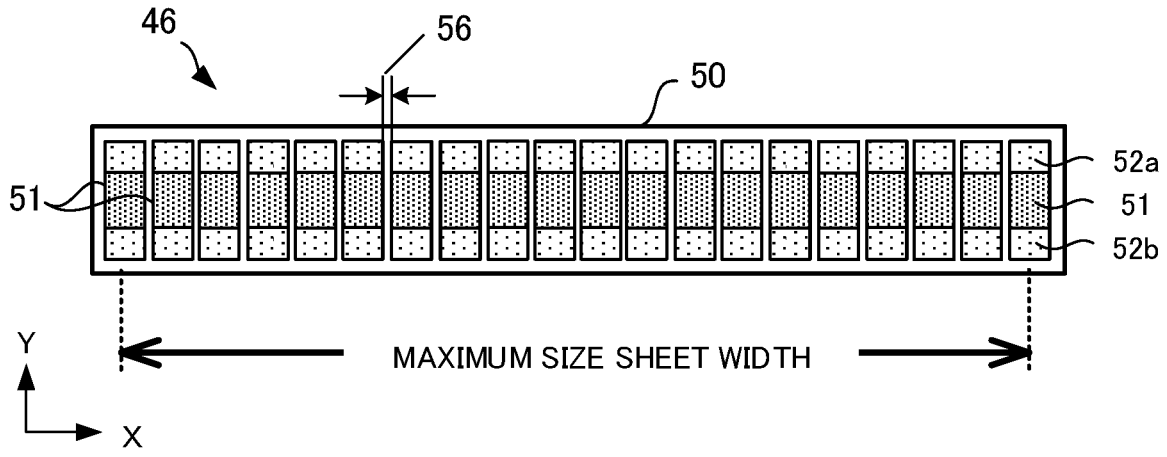
FIG. 5 is a plan view showing a basic configuration of a heating member in the first embodiment.

FIG. 5 is a plan view showing a basic configuration of the heating member 46 in the first embodiment. The heating member 46 is configured by a heating member group. As shown in FIG. 5, in the heating member 46, a plurality of heat generating members 51 having a predetermined width are arrayed in a longitudinal direction (the left-right direction in the figure) on a heat resistant insulating substrate, for example, a ceramic substrate 50. The heat generating member group configures a heat generating section including a plurality of divided regions.

The heat generating members 51 are formed by, for example, stacking a heat generation resistance layer or a glaze layer and the heat generation resistance layer on one surface of the ceramic substrate 50. The glaze layer does not have to be present. As explained above, the heat generation resistance layer configures the heat generating members 51. The heat generation resistance layer is formed of a known material such as $TaSiO_2$. The heat generating members 51 are divided into a predetermined length and a predetermined number of pieces in the longitudinal direction of the heating member 46. Details of the disposition of the heat generating members 51 are explained below. Electrodes 52*a* and 52*b* are formed at both end portions in a latitudinal direction of the heating member 46, that is, a sheet conveying direction of the heat generating members 51 (the up-down direction in the figure).

Note that the sheet conveying direction (the latitudinal direction of the heating member 46) is explained as a Y direction in the following explanation. The longitudinal direction of the heating member 46 is a direction orthogonal to the sheet conveying direction. The longitudinal direction of the heating member 46 corresponds to the main scanning direction in forming an image on a sheet, that is, a sheet width direction. The longitudinal direction of the heating member 46 is explained as an X direction in the following explanation.

Figure 6:
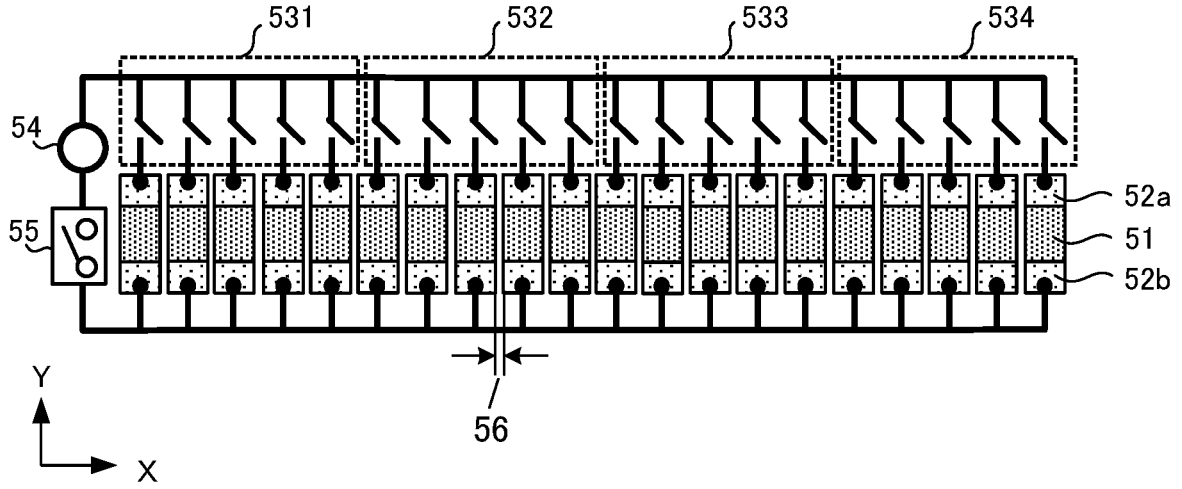
FIG. 6 is an explanatory diagram showing a connection state of a heat generating member group of the heating member shown in FIG. 5 and driving circuits.

FIG. 6 is an explanatory diagram showing a connection state of the heat generating member group of the heating member 46 shown in FIG. 5, that is, the heat generating section including the plurality of divided regions and a driving circuit. In FIG. 6, the plurality of heat generating members 51 are respectively individually controlled to be energized by a plurality of driving ICs (integrated circuits) 531, 532, 533, and 534. That is, the electrodes 52*a* of the heat generating members 51 are connected to one end of a driving source 54 via the driving ICs 531, 532, 533, and 534. The electrodes 52*b* are connected to the other end of the driving source 54.

As specific examples of the driving ICs 531 to 534, a switching element formed by an FET, a triac, a switching IC, and the like can be used. Switches of the driving ICs 531 to 534 are turned on, whereby the heat generating members 51 are energized by the driving source 54. Therefore, the driving ICs 531 to 534 configure switching units of the heat generating members 51. As the driving source 54, for example, an AC power supply (AC) and a DC powers supply (DC) can be used. Note that, in the following explanation, the driving ICs 531 to 534 are sometimes collectively referred to as driving ICs 53.

A temperature adjusting element 55 may be connected to the driving source 54 in series. The temperature adjusting element 55 is formed by, for example, a thermostat. The thermostat 55 (temperature adjusting element) is turned on and off according to the temperature of the heat generating members 51. The thermostat 55 is turned off if the heat generating members 51 reach temperature (a dangerous temperature) set in advance, interrupts connection of the driving source 54 and the heat generating members 51, and prevents the heat generating members 51 from being abnormally heated.

Figure 7:
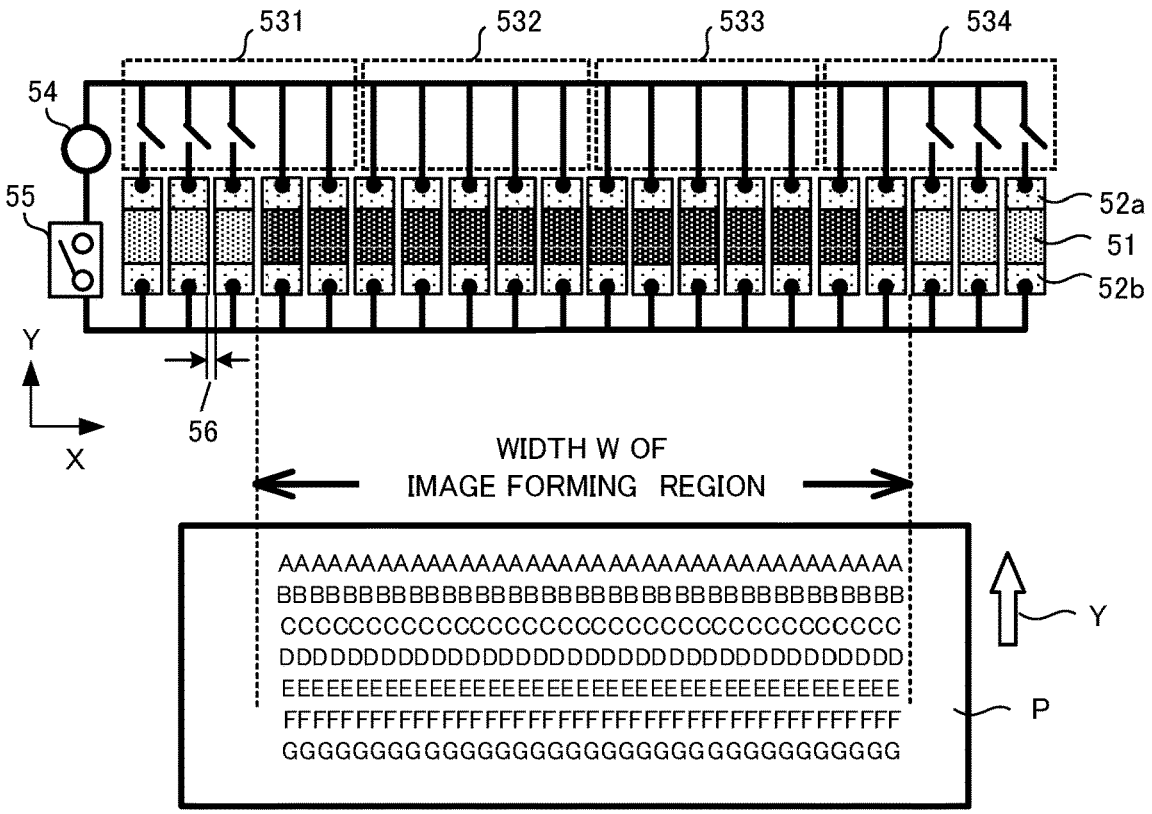
FIG. 7 is an explanatory diagram showing a positional relation between the heat generating member group shown in FIG. 6 and a printing region of a sheet.

FIG. 7 is a diagram for explaining a positional relation between the heat generating member group shown in FIG. 6 and a printing region of a sheet. In FIG. 7, assumed that the sheet P is conveyed in an arrow Y direction. In FIG. 7, a state in shown in which the switch of the driving IC 53 connected to the heat generating member 51 present in a position corresponding to the printing region of the sheet (width W of an image forming region) is selectively turned on and the heat generating member 51 is energized and heated. That is, only the printing region of the sheet P is intensively heated.

Before the sheet P is conveyed into the fixing apparatus 36, the size of the printing region of the sheet P is determined. As a method of determining the printing region of the sheet P, there is a method of using an analysis result of image data read by the scanner unit 15 and image data created by a personal computer or the like. There are also a method of determining the printing region on the basis of a printing format information such as margin setting on the sheet P and a method of determining the printing region on the basis of a detection result of an optical sensor.

Figure 8:
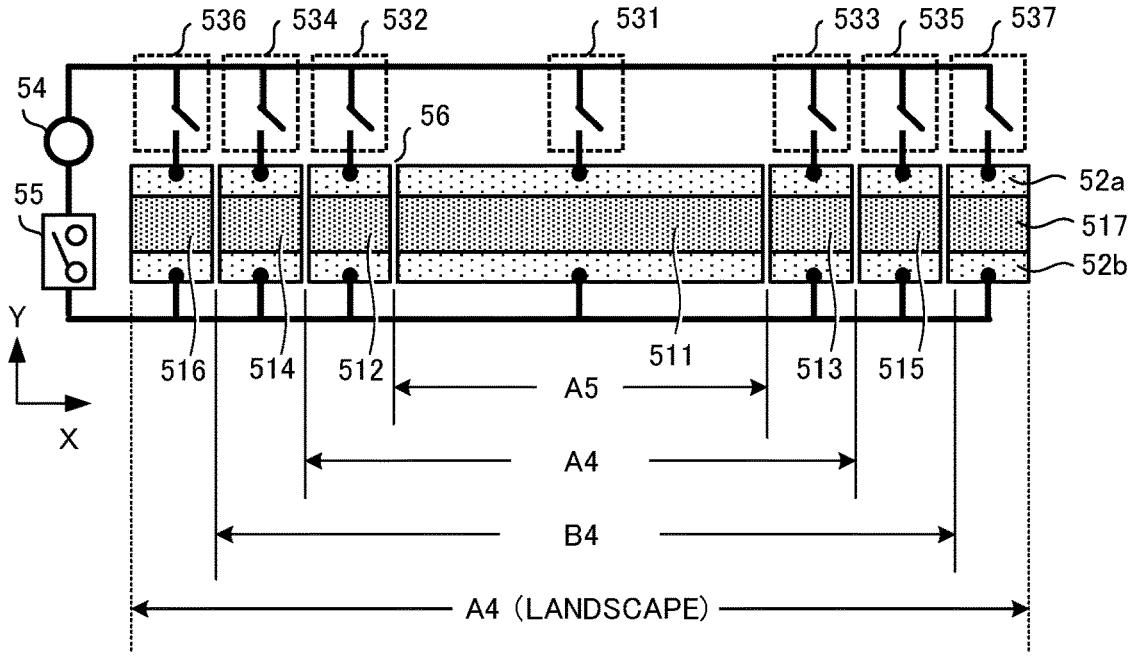
FIG. 8 is a diagram showing a disposition example of the heat generating member group in the first embodiment.

FIG. 8 is a diagram showing a disposition example of the heat generating member group, that is, the heat generating section including the plurality of divided regions in the first embodiment. There are various sizes of the sheet P conveyed to the fixing apparatus 36. For example, an A5 size (148 mm), an A4 size (210 mm), a B4 size (257 mm), and an A4 landscape size (297 mm) are relatively often used.

Therefore, in FIG. 8, the heat generating members 51 are divided into a plurality of blocks according to sheet sizes (the four kinds of sizes described above) and the heat generating members 51 having a plurality of kinds of width are divided and arrayed in the X direction. The heat generating member group is energized to have a margin of approximately 5% in a heating region taking into account conveyance accuracy and a generation of a skew of a conveyed sheet or release of heat to a non-heated portion.

For example, among the four kinds of sizes, a heat generating member 511 of a first block is provided in the center in the X direction to correspond to the width (148 mm) of the A5 size, which is the minimum size. Heat generating members 512 and 513 of a second block are provided on the outer side in the X direction of the heat generating member 511 to correspond to the width (210 mm) of the A4 size larger than the A5 size. Similarly, heat generating members 514 and 515 of a third block are provided on the outer side of the heat generating members 512 and 513 to correspond to the width (257 mm) of the B4 size larger than the A4 size. Heat generating members 516 and 517 of a fourth block are provided on the outer side of the heat generating members 514 and 515 to correspond to the width (297 mm) of the A4 landscape size larger than the B4 size.

The electrodes 52*a* of the heat generating members (511 to 517) are connected to one end of the driving source 54 via the driving ICs 531 to 537. The electrodes 52*b* are connected to the other end of the driving source 54. Note that the number of divided blocks and the widths of the heat generating members (511 to 517) shown in FIG. 8 are described as an example and are not limited to the example.

In FIG. 8, if the sheet P of the minimum size (A5) is conveyed, only the driving IC 531 connected to the heat generating member 511 of the first block in the center is switched on. As the size of the sheet P increases, the driving ICs (532 to 537) connected to the heat generating members (512 to 517) of the second to fourth blocks are respectively sequentially switched on.

In this embodiment, a line sensor 40 (see FIG. 1) is disposed in a paper passing region to make it possible to determine a size and a position of a passing sheet on a real-time basis. Alternatively, a sheet size may be determined during a start of a printing operation from image data or information concerning the paper feeding cassettes 18 in which sheets are stored in the MFP 10.

Incidentally, in the heating member 46, in order to manage the temperature of the fixing belt 41, it is necessary to grasp the temperature of the heat generating members (511 to 517) using temperature sensors and properly control a heat generation temperature. However, to perform accurate temperature control, necessary to perform wiring in a state in which a circuit for power feed to the heater and the temperature sensors are completely insulated from each other. Further, since a heat resistant wire is necessary, a configuration is extremely complicated in the past.

Therefore, in the heater and the fixing apparatus according to the embodiment, the insulating substrate of the heating member is formed in a multiplayer structure. Temperature sensors and wiring patterns for power feed are stacked on the insulating substrate. The temperature sensors are set for each of blocks of the divided heat generating members.

Figure 9A:
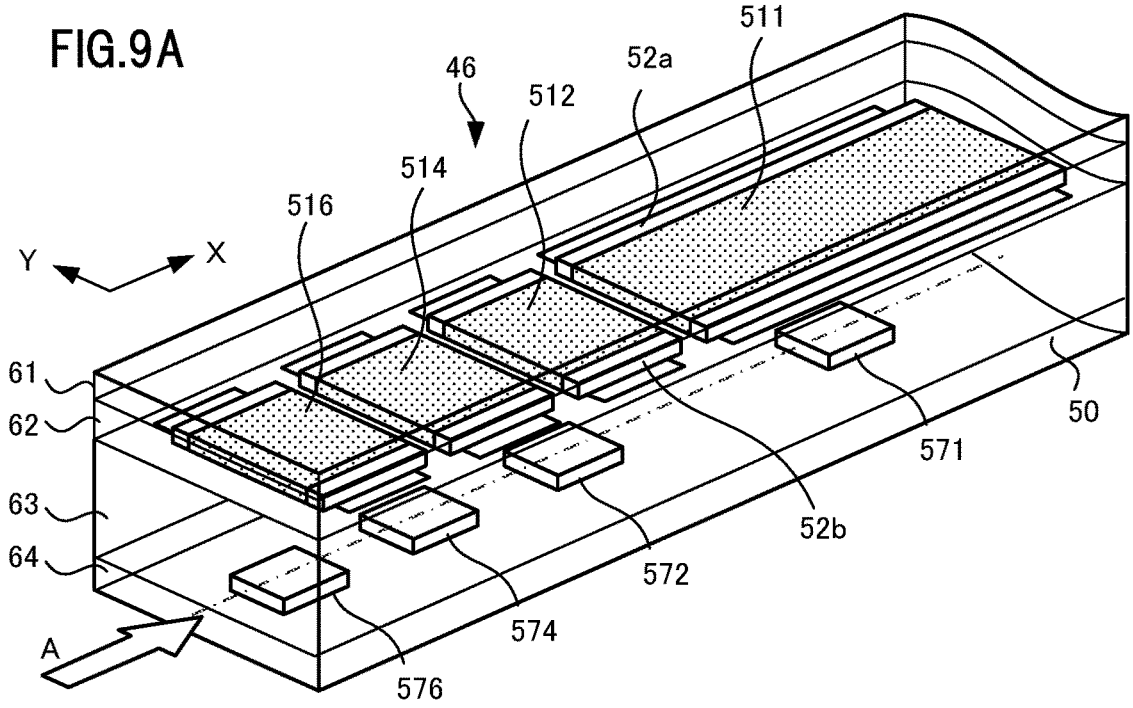
FIGS. 9A to 9C are a perspective view and sectional views showing the configuration of a main part of the heating member in the first embodiment.
Figure 9B:
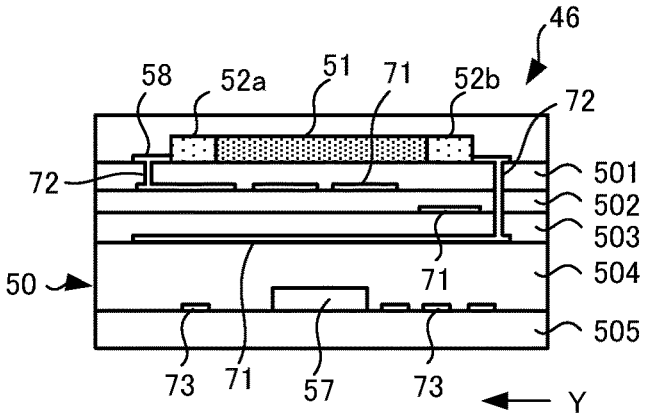
Figure 9C:
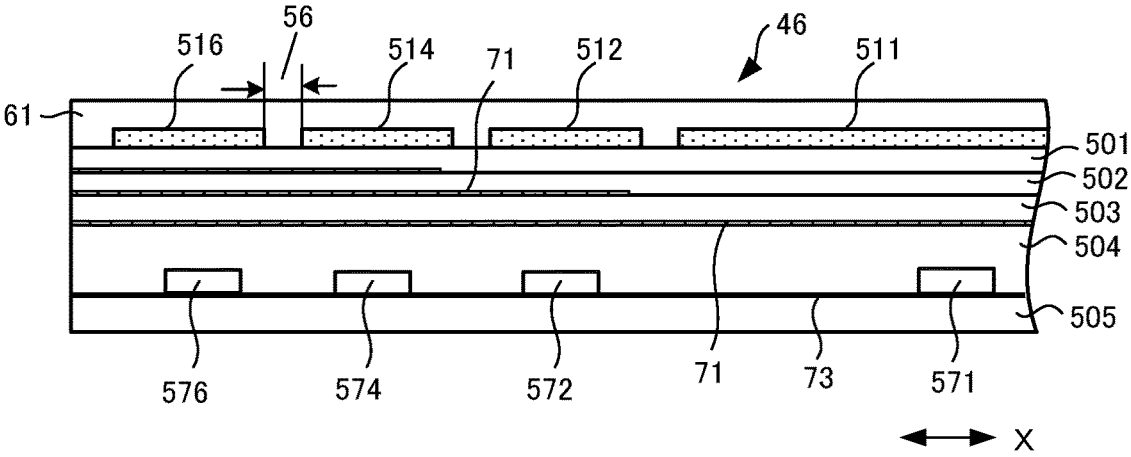

FIGS. 9A to 9C are diagrams showing the configuration of a main part of the heating member 46 (the heater) according to the embodiment. FIG. 9A is a perspective view of the heating member 46. FIG. 9B is a sectional view of the heating member 46 viewed from an arrow A direction in FIG. 9A. FIG. 9C is a schematic sectional view of the heating member 46 viewed from the Y direction.

The heating member 46 shown in FIGS. 9A to 9C corresponds to the example shown in FIG. 8. In FIGS. 9A to 9C, only the heat generating members 511, 512, 514, and 516 are shown. The heat generating members 513, 515, and 517 are symmetrically configured with respect to the disposition of the heat generating members 512, 514, and 516 centering on the heat generating member 511. Therefore, the heat generating members 513, 515, and 517 are not shown in the figure. Note that, in the following explanation, the heat generating members 511, 512, 514, and 516 are sometimes collectively referred to as heat generating members 51.

As shown in FIG. 9A, the ceramic substrate 50, which is the heat resistant insulating substrate, is formed in a multilayer structure. A layer on the surface (an upper part of the figure) is a protecting layer 61. A layer 62 of a heat generating member is disposed under the protecting layer 61. A layer 63 of a wiring pattern and a layer 64 of a sensor are disposed below the layer 62.

As shown in FIGS. 9B and 9C, the protecting layer 61 is formed of a material different from the material of the ceramic substrate 50, for example, $Si_3N_4$ to cover the heat generating members 51. In the layer 62 of the heat generating member, a heat generation resistance layer is directly stacked on a ceramic substrate 501 (alternatively, a glaze layer and the heat generation resistance layer are stacked on the ceramic substrate 501).

The heat generation resistance layer configures the heat generating members 511, 512, 514, and 516 and is formed of a known material such as $TaSiO_2$. The heat generating members 51 on the ceramic substrate 501 are arrayed in the longitudinal direction of the ceramic substrate 501 (the X direction) with a predetermined gap 56 (see FIG. 9C) apart from one another.

The layer 63 of the wiring pattern is configured by ceramic substrates 502, 503, and 504 of a plurality of layers (in the figure, three layers). Wiring patterns 71 are formed on the respective layers by screen printing or the like. In FIG. 9A to FIG. 9C, the wiring patterns 71 are formed on the ceramic substrates 502, 503, and 504 of the three layers.

However, the wiring patterns 71 may be formed on a ceramic substrate of at least one layer of three or less layers or three or more layers.

On the ceramic substrates 502 and 503, for example, wiring patterns of individual electrodes for feeding electric power to the heat generating members 511, 512, 514, and 516 are formed. On the ceramic substrate 504, a wiring pattern of a common electrode for feeding electric power to the heat generating members 51 is formed. The ceramic substrates 501, 502, and 503 are connected by a through-hole 72 as shown in FIG. 9B. The through-hole 72 is formed by, for example, filling silver paste in a hole piercing through the substrates.

In a layer of the insulating substrate different from a layer in which the heat generating section (the plurality of heat generating members 51) is formed, temperature sensors for detecting the temperature of the heat generating section and wiring patterns for power feed to the temperature sensors are formed. That is, in the layer 64 of the sensor, a plurality of temperature sensors 571, 572, 574, and 576 configured by, for example, thermocouples are set on another layer of the insulating substrate, for example, a fifth ceramic substrate 505. On the fifth ceramic substrate 505, a wiring pattern 73 for feeding electric power to the temperature sensors 571, 572, 574, and 576 is formed. Note that, in the following explanation, the temperature sensors 571, 572, 574, and 576 are sometimes collectively referred to as temperature sensors 57.

The plurality of temperature sensors 57 are set to correspond to the divided blocks of the heat generating members 51. That is, if the heat generating member is divided into a plurality of blocks to correspond to a sheet size, the temperature sensors 571, 572, 574, and 576 are respectively provided to correspond to the heat generating members 511, 512, 514, and 516 of the first to fourth blocks. Through-holes 72 and 74 (explained below) are formed from the ceramic substrate 504 to the ceramic substrate 501. A specific example of the wiring patterns 71 and 73 of the layers is explained below.

A method of forming the heat generating members 51 (the heat generation resistance layer) on the ceramic substrate 501 is the same as a known method (e.g., a method of forming a thermal head). An electrode layer is formed of aluminum, gold, silver, or the like on the heat generation resistance layer. Heat generating members adjacent to each other are insulated. The electrodes 52*a* and 52*b* are formed of aluminum, gold, silver, or the like in the Y direction on the ceramic substrate 501 in a pattern in which the heat generating members 51 are exposed.

An electric conductor 58 for wiring is connected to aluminum layers (the electrodes 52*a* and 52*b*) at both ends of the heat generating members 51. The electric conductor 58 is connected to, by the through-hole 72, the wiring patterns 71 formed on the ceramic substrates 502, 503, and 504. The electric conductor 58 connects the switching elements of the driving ICs 53 respectively to the wiring patterns 71. Therefore, power feed to the heat generating members 51 is performed from the driving source 54 via the wiring patterns 71, the electric conductor 58, and the switching elements of the driving ICs 53.

Further, the protecting layer 61 is formed in a top section to cover all of the heat generating members 51, the aluminum layers (the electrodes 52*a* and 52*b*), the electric conductor 58, and the like on the ceramic substrate 501.

If AC or DC is supplied to the heat generating member group from the driving source 54, the switching elements (triacs or FETs) of the driving ICs are desirably switched by a zero-cross circuit to take into account flicker as well.

Figure 10:
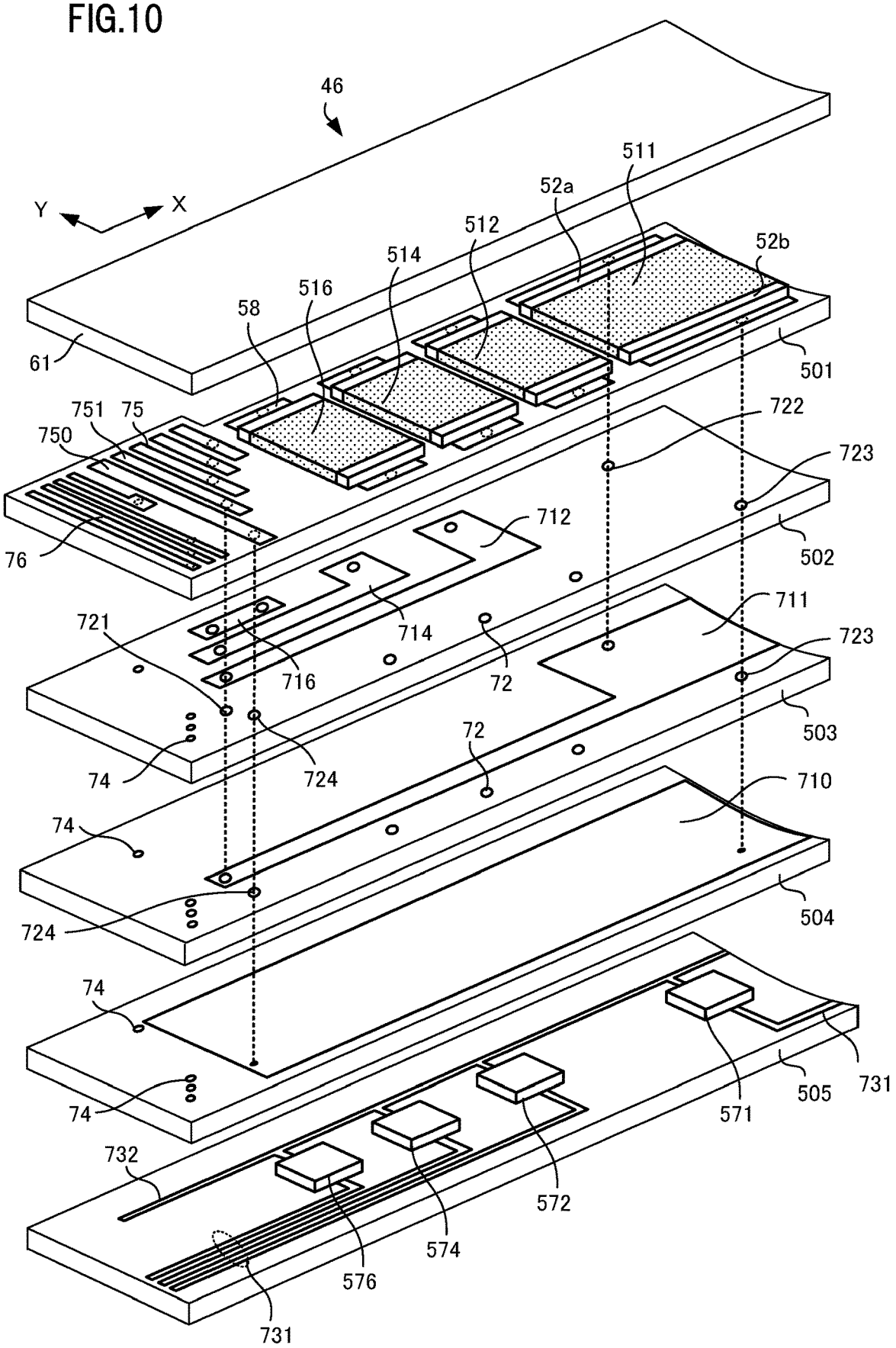
FIG. 10 is an exploded perspective view showing the configuration of the heating member in the first embodiment.

FIG. 10 is an exploded perspective view of the configuration of the heating member 46 in the first embodiment.

As shown in FIG. 10, the heating member 46 includes the insulating substrate of the heat resistant multilayer structure (the first to fifth ceramic substrates 501 to 505) under the protecting layer 61. The protecting layer 61 is formed of, for example, $Si_3N_4$. A plurality of through-holes 72 and 74 are formed among the first to fifth ceramic substrates 501 to 505. The through-holes 72 and 74 are formed by, for example, filling silver paste in holes piercing through the substrates.

The heat generation resistance layer is directly stacked on the first ceramic substrate 501 or the glaze layer and the heat generation resistance layer are stacked on the ceramic substrate 501. The heat generation resistance layer configures the heat generating members 511, 512, 514, and 516 and is formed of a known material such as $TaSiO_2$. The heat generating members 51 are arrayed in the longitudinal direction of the ceramic substrate 501 (the X direction) with a predetermined gap apart from one another. Wiring patterns 75 and 76 configuring socket electrodes are formed at an end portion on the first ceramic substrate 501. The wiring patterns 75 and 76 are hereinafter referred to as socket patterns.

On the second ceramic substrate 502, wiring patterns 712, 714, and 716 are formed by screen printing or the like. The wiring patterns 712, 714, and 716 are wiring patterns of individual electrodes for feeding electric power to the heat generating members 512, 514, and 516.

On the third ceramic substrate 503, a wiring pattern 711 is formed by the screen printing or the like. The wiring pattern 711 is a wiring pattern of an individual electrode for feeding electric power to the heat generating member 511. On the fourth ceramic substrate 504, a wiring pattern 710 of a common electrode for feeding electric power to the heat generating members 511, 512, 514, and 516 is formed.

On the fifth ceramic substrate 505, a plurality of temperature sensors 571, 572, 574, and 576 for temperature detection configured by, for example, thermocouples are set to correspond to the positions of the heat generating members 511, 512, 514, and 516. On the fifth ceramic substrate 505, wiring patterns 731 of individual electrodes for feeding electric power to the temperature sensors 571, 572, 574, and 576 and a wiring pattern 732 of a common electrode are formed.

The through-holes 72 provided among the ceramic substrates 501, 502, 503, and 504 are through-holes for power feed to the heat generating members 511, 512, 514, and 516. A part of the through-holes 72 are connected to the socket patterns 75. The through-holes 74 are through-holes for power feed to the temperature sensors 571, 572, 574, and 576. The through-holes 74 are connected to the socket patterns 76.

A wiring pattern for connecting the thermostat 55 may be disposed on the ceramic substrate 50. The wiring pattern for the thermostat 55 is disposed on, for example, the layer 64 of the sensor, that is, the fifth ceramic substrate 505. A wiring pattern for connecting the thermostat 55 is desirably provided in the socket pattern 75.

Note that temperature sensors can also be mounted on a rear side surface layer (a rear surface) of the ceramic substrate 505. In this case, the temperature sensors on the fifth ceramic substrate 505 only have to be wired to the temperature sensors disposed on the rear surface via through-holes using, for example, a method of forming electrodes in a multilayer structure of an insulating substrate.

The wiring patterns 731 for the individual electrodes for feeding electric power to the temperature sensors 57 and the wiring pattern 732 for the common electrode may be disposed on the rear surface of the fifth ceramic substrate 505. Similarly, the wiring pattern for thermostat 55 can also be disposed on the rear surface of the fifth ceramic substrate 505.

If the temperature sensors are mounted or the wiring patterns are disposed on the rear surface of the fifth ceramic substrate 505, a protecting layer same as the protecting layer 61 is desirably provided on the rear surface of the fifth ceramic substrate 505.

In this way, the wiring pattern for the thermostat 55 is also formed in anyone of the layers of the ceramic substrate 50 of the multilayer structure. Consequently, possible to dispose all of the circuit patterns configuring the heating member 46 in the layers of one ceramic substrate 50, and possible to improve heat resistance and insulation. Connection to an external circuit element can be performed via the socket patterns 75 and 76. Therefore, wiring is simplified.

Power feed to the heat generating members 51 is explained. For example, power feed to the heat generating member 511 is performed as indicated by a dotted line in FIG. 10. That is, if a wiring pattern 751 of the socket pattern 75 is set as a power feed start point, electric power is fed to the electrodes 52*a* of the heat generating member 511 of the first ceramic substrate 501 via a through-hole 721, the wiring pattern 711 of the third ceramic substrate 503, and a through-hole 722. Electric power is fed from the electrodes 52*b* of the heat generating member 511 to a wiring pattern 750 of the first ceramic substrate 501 via a through-hole 723, the wiring pattern 710 of the fourth ceramic substrate 504, and a through-hole 724.

As power feed to the other heat generating members 512, 514, and 516, similarly, electric power is fed from the socket patterns 75 to the electrodes 52*a* of the heat generating members 512, 514, and 516 via the through-holes 72 and the wiring patterns 712, 714, and 716 of the second ceramic substrate 502. Electric power is fed from the electrodes 52*b* of the heat generating members 512, 514, and 516 to the socket patterns 75 via the through-holes 72, the wiring pattern 710 of the fourth ceramic substrate 504, and the through-holes 72.

As power feed to the temperature sensors 57, electric power is fed from the socket patterns 76 to one ends of the temperature sensors 57 via the through-holes 74 and the wiring patterns 731 of the fifth ceramic substrate 505. Electric power is fed from the other ends of the temperature sensors 57 to the socket patterns 76 via the common wiring pattern 732 and the through-holes 74.

The through-holes 72 provided among the ceramic substrates 501, 502, 503, and 504 are through-holes for power feed to the heat generating members 511, 512, 514, and 516. A part of the through-holes 72 are connected to the socket patterns 75. The through-holes 74 are through-holes for power feed to the temperature sensors 571, 572, 574, and 576. The through-holes 74 are connected to the socket patterns 76.

Figure 11A:
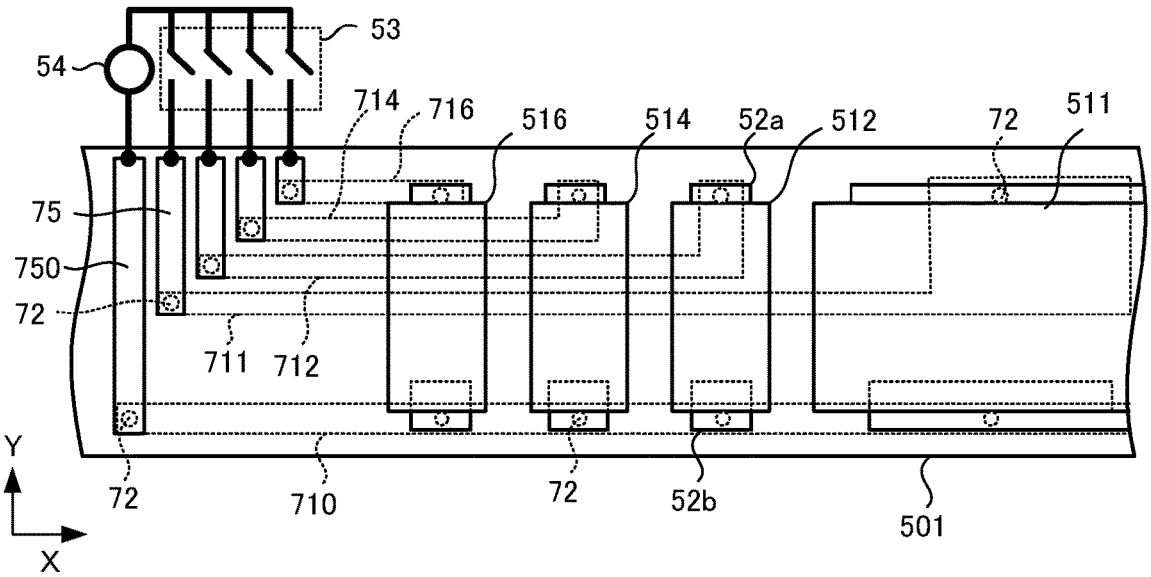
FIGS. 11A and 11B are explanatory diagrams showing a connection state of heat generating members and the driving circuits and a connection state of temperature sensors and sensing circuits in the first embodiment.
Figure 11B:
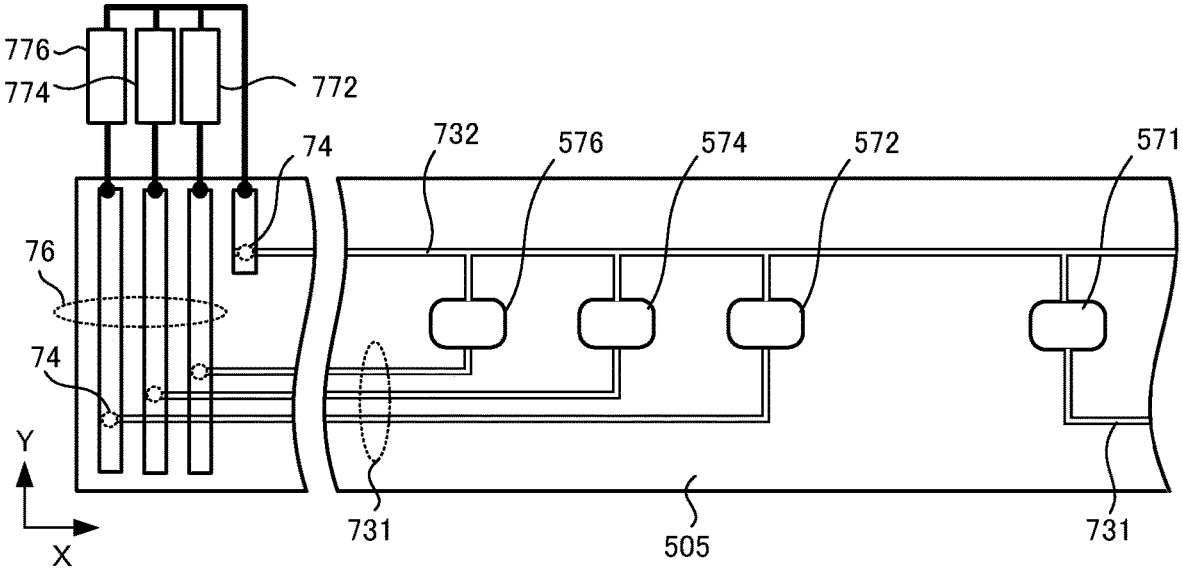

FIG. 11A is an explanatory diagram showing a connection state of the heat generating members and the driving ICs in the first embodiment. FIG. 11B is an explanatory diagram showing a connection state of the temperature sensors and sensing circuits.

As shown in FIG. 11A, as power feed to the heat generating members 51, electric power is fed from the socket patterns 75 to the electrodes 52*a* of the heat generating members 51 via the through-holes 72 and the wiring patterns 711, 712, 714, and 716. Electric power is fed from the electrodes 52*b* of the heat generating members 51 to the socket patterns 75 via the through-holes 72 and the wiring pattern 710. The driving source 54 is connected to the wiring pattern 750 of the socket patterns 75. The driving ICs 53 are connected to the other socket patterns 75. Note that the wiring patterns 71 for the heat generating members 513, 515, and 517 are connected to socket patterns (not shown in the figure) formed at the other end portion (the right in the figure) of the ceramic substrate 501.

As shown in FIG. 11B, as power feed to the temperature sensors 57, electric power is fed from the socket patterns 76 to one ends of the temperature sensors 57 via the through-holes 74 and the wiring patterns 731. Electric power is fed from the other ends of the temperature sensors 57 to the socket patterns 76 via the wiring patterns 732 and the through-holes 74. Sensing circuits 772, 774, and 776 are connected to the socket patterns 76. Note that the wiring pattern 731 for the temperature sensor 571 is connected to socket patterns (not shown in the figure) formed at the other end portion (the right in the figure) of the ceramic substrate 505.

As explained above, with the heater and the fixing apparatus according to the embodiment, the temperature sensors and the wiring patterns for power feed to the temperature sensors are embedded in the inside of the insulating substrates (the ceramic substrates) forming the heat generation members. Therefore, possible to reduce the size of the entire heating member 46. Since the temperature sensors are set for each of the divided blocks of the heat generating members, and possible to detect the temperature of a portion that is generating heat and properly control the temperature.

Further, the wiring patterns for power feed to the temperature sensors are formed in the layer in which the temperature sensors are formed in the insulating substrate. Therefore, possible to individually design wiring of the wiring patterns for power feed to the temperature sensors with respect to the wiring patterns for power feed to the heat generating section, thereby facilitating the substrate design.

Note that the temperature sensors 57 are basically respectively set to correspond to the divided blocks of the heat generating members 51. However, the temperature sensors 57 disposed at both the end portions in the longitudinal direction of the heating member 46 are likely to be affected by the influence of the outdoor air and detect temperature lower than actual temperature. Therefore, the temperature sensors 57 set at both the end portions of the heating member 46 are desirably set in positions further shifted to the inner side of the heating member 46 than the center positions of the divided blocks.

In the embodiment, the heat generation of a portion equivalent to an image size is explained. However, also possible to segment the heat generating members and heat only a place where an image is present or heat a place where a temperature difference is partially present because of some reasons while correcting the temperature difference.

Figure 12:
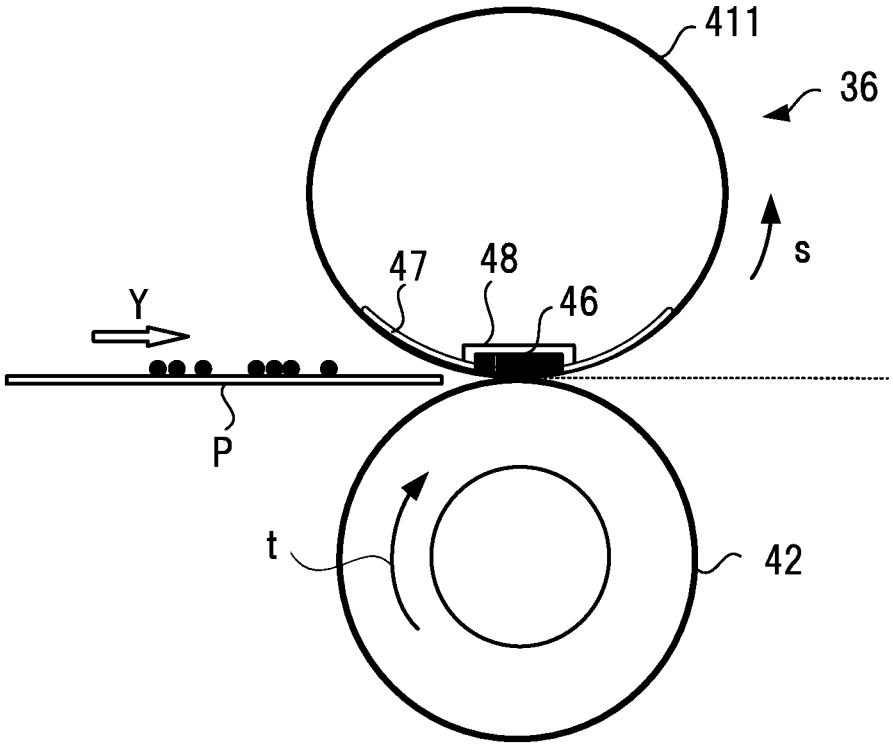
FIG. 12 is a configuration diagram showing a modification of the fixing apparatus according to the first embodiment.

FIG. 12 is a configuration diagram showing a modification of the heating member 46 (the heater) and the fixing apparatus 36 according to the first embodiment.

In the fixing apparatus 36 shown in FIG. 12, the fixing belt 41 shown in FIG. 3 is replaced with a cylindrical fixing belt (an endless belt) 411. The fixing apparatus 36 includes the fixing belt 411 and the press roller 42.

A driving force is transmitted to the press roller 42 by a motor and the press roller 42 rotates (a rotating direction is indicated by an arrow t in FIG. 12). The fixing belt 411 rotates following the rotation of the press roller 42 (a rotating direction is indicated by an arrows in FIG. 12). The tabular heating member 46 is provided to be opposed to the press roller 42 on the inner side of the fixing belt 411.

An arcuate guide 47 is provided on the inner side of the fixing belt 411. The fixing belt 411 is attached along the outer circumference of the guide 47. The heating member 46 is supported by a supporting member 48 attached to the guide 47. The heating member 46 is in contact with the inner side of the fixing belt 411 and pressed in the direction of the press roller 42. Therefore, a fixing nip having a predetermined width is formed between the fixing belt 411 and the press roller 42. If the sheet P passes the fixing nip, a toner image on the sheet P is fixed on the sheet P with heat and pressure.

That is, the fixing belt 411 revolves around the heating member 46 while being supported by the guide 47. The heating member 46 has the basic configuration shown in FIG. 6 or 8. The heating member 46 is formed on the ceramic substrate 50 of the multilayer structure as shown in FIG. 10.

Figure 13:
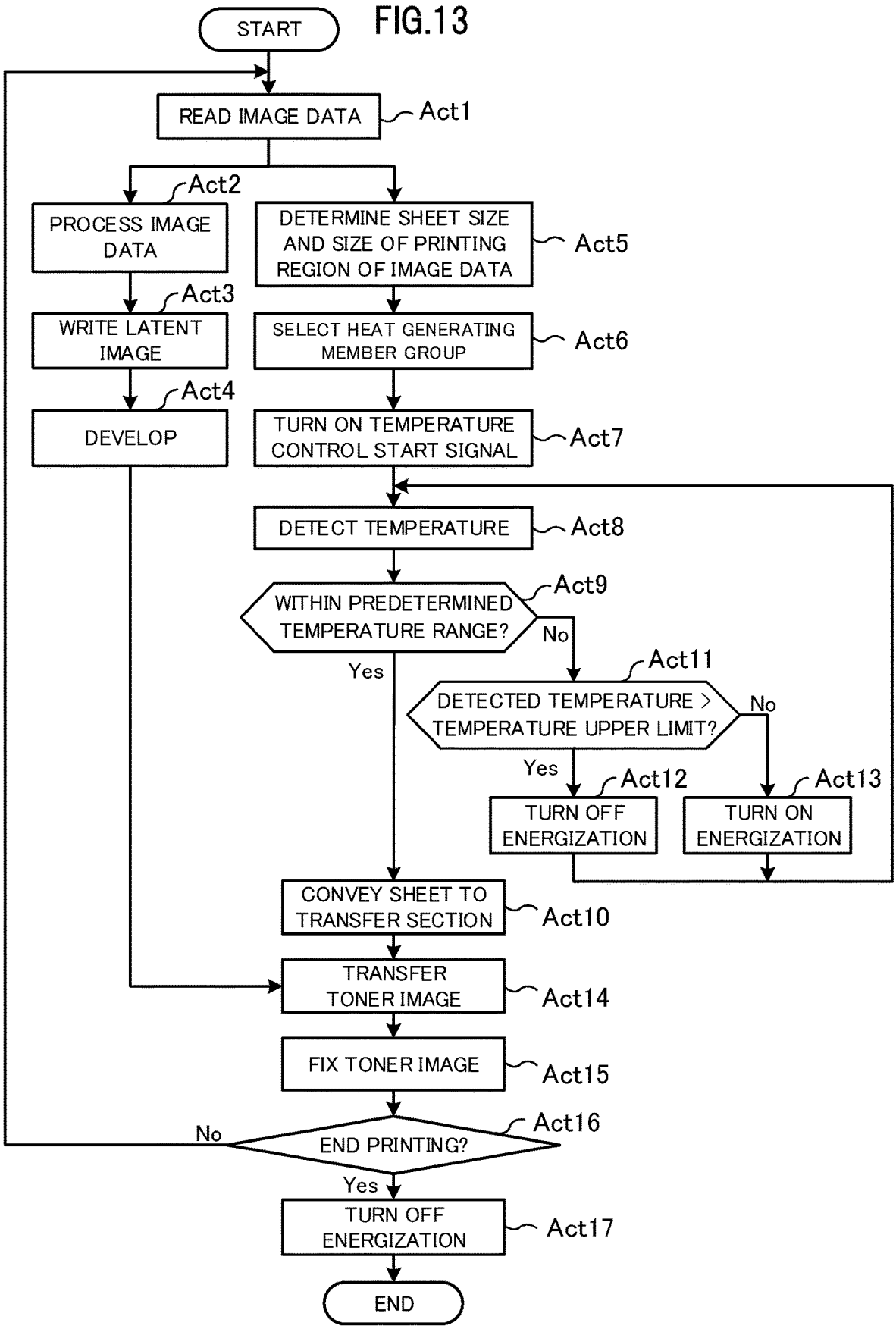
FIG. 13 is a flowchart showing a control operation of the MFP in the embodiment.

Operation during printing of the MFP 10 configured as explained above is explained with reference to a flowchart of FIG. 13. FIG. 13 is a flowchart showing a specific example of control by the MFP 10 in the first embodiment.

First, if the scanner unit 15 reads image data in Act 1, the CPU 100 executes an image formation control program in the imaging forming unit 20 and a fixing temperature control program in the fixing apparatus 36 in parallel.

If image formation processing is started, in Act 2, the CPU 100 processes the read image data. In Act 3, an electrostatic latent image is written on the surface of the photoconductive drum 22. In Act 4, the developing device 24 develops the electrostatic latent image.

On the other hand, if fixing temperature control processing is started, in Act 5, the CPU 100 determines a sheet size and the size of a printing range of the image data. The determination is performed on the basis of, for example, a detection signal of the line sensor 40, sheet selection information by the operation panel 14*a*, or an analysis result of the image data.

In Act 6, the fixing control circuit 150 selects, as a heat generation target, a heat generating member group disposed in a position corresponding to the printing range of the sheet P. For example, the heat generating member 511 disposed in the center to correspond to the width of the printing region in the example shown in FIG. 8 is selected.

Subsequently, if the CPU 100 turns on a temperature control start signal to the selected heat generating member 51 in Act 7, energization to the selected heat generating member group is performed and temperature rises.

Subsequently, in Act 8, the CPU 100 detects the temperature of the heat generating member group on the basis of a detection result of the temperature sensors 57 disposed on the inner side of the heating member 46. Further, in Act 9, the CPU 100 determines whether the temperature of the heat generating member group is within a predetermined temperature range. If determining that the temperature of the heat generating member group is within the predetermined temperature range (Yes in Act 9), the CPU 100 proceeds to Act 10. On the other hand, if determining that the temperature of the heat generating member group is not within the predetermined temperature range (No in Act 9), the CPU 100 proceeds to Act 11.

In Act 11, the CPU 100 determines whether the temperature of the heat generating member group exceeds a predetermined temperature upper limit value. If determining that the detected temperature of the heat generating member group exceeds the predetermined temperature upper limit value (Yes in Act 11), in Act 12, the CPU 100 turns off energization to the heat generating member group selected in Act 6 and returns to Act 8.

If determining that the temperature of the heat generating member group does not exceed the predetermined temperature upper limit value (No in Act 11), the temperature is lower than a predetermined temperature lower limit value according to the determination result in Act 9. Therefore, in Act 13, the CPU 100 maintains the energization to the heat generating member group in the ON state or turns on the energization again and returns to Act 8.

Subsequently, in Act 10, the CPU 100 conveys the sheet P to a transfer section a state in which the temperature of the heat generating member group is within the predetermined temperature range. In Act 14, the CPU 100 transfers a toner image onto the sheet P. After transferring the toner image onto the sheet P, the CPU 100 conveys the sheet P into the fixing apparatus 36.

Subsequently, in Act 15, the fixing apparatus 36 fixes the toner image on the sheet P. In Act 16, the CPU 100 determines whether to end the print processing of the image data. If determining to end the print processing (Yes in Act 16), in Act 17, the CPU 100 turns off the energization to all the heat generating member groups and ends the processing. On the other hand, if determining not to end the print processing of the image data yet (No in Act 16), that is, if printing target image data remains, the CPU 100 returns to Act 1 and repeats the same processing until the processing ends.

As explained above, in the heating member 46 (the heater) and the fixing apparatus 36 according to this embodiment, the heat generating member group of the heating member 46 is divided and disposed in the longitudinal direction of the heating member 46 (the X direction) orthogonal to the sheet conveying direction Y and disposed in contact with the inner side of the fixing belt 41. Any one of the heat generating member groups is selectively energized to correspond to a printing range (an image forming region) of image data. Therefore, possible to prevent abnormal heat generation of a non-paper passing portion of the heating member 46 and suppress useless heating of the non-paper passing portion. Therefore, possible to greatly reduce thermal energy.

The heat generating members, the temperature sensors, and the wiring patterns for power feed to the temperature sensors are stacked and formed on the insulating substrate. Therefore, possible to perform wiring in a state in which the circuit for power feed to the heater and the temperature sensors are completely insulated from each other. It is possible to reduce the size of the entire heating member 46. Since the heat resistant insulating substrate is used as the insulating substrate, and possible to perform heat resistant wiring.

Note that the formation of the heat generation resistance layer on the ceramic substrate 50, the formation of the wiring patterns, and the setting of the temperature sensors can also be configured by an LTCC (Low Temperature Co-fired ceramics) multilayer substrate. The LTCC multilayer substrate is known as a low-temperature baked stacked ceramics substrate formed by simultaneously baking a wiring conductor and a ceramics substrate at low temperature of, for example, 900° C. or less.

In the example explained above, as shown in FIG. 8, the heat generating members are divided into the plurality of blocks and the temperature sensors are also set to correspond to the divided blocks. However, even in the configuration in which the large number of heat generating members are continuously arrayed as shown in FIG. 5, if the number of layers of the ceramic substrate is increased and the number of wiring patterns is increased, possible to dispose the heat generating members and the temperature sensors in one insulating substrate. In this case, the temperature sensors are desirably distributed disposed in the center and the periphery of the heating member 46 to correspond to the plurality of sheet sizes.

The insulating substrate may be formed of a heat resistant and insulative glass material other than the ceramic. Further, the electrodes can also be formed of a material other than the metal material explained in the embodiment.

While certain embodiments have been described, these embodiments have been presented by way of example only, and are not intended to limit the scope of the invention. Indeed, the novel apparatus described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

What is claimed is:

1. A heater comprising:

a heat generating member in a first layer;

a sensor that is in a second layer different from the first layer and configured to detect a temperature of the heat generating member; and a wiring pattern in one or more third layers between the first and second layers to supply power to the heat generating member.

2. The heater of claim 1, further comprising:

another wiring pattern to supply power to the sensor.

3. The heater of claim 2, wherein said another wiring pattern is included in a layer other than the third layers.

4. The heater of claim 1, wherein the heat generating member extends along a longitudinal direction of the heater.

5. The heater of claim 1, wherein the wiring pattern comprises:

a first pattern electrically connected to one electrode of the heat generating member, and a second pattern electrically connected to another electrode of the heat generating member.

6. The heater of claim 5, wherein the first and second patterns are included in different layers.

7. The heater of claim 5, wherein the wiring pattern further comprises a third pattern electrically connected to an electrode of another heat generating member, and the first and third patterns are included in different layers.

8. The heater of claim 5, wherein the first pattern and said one electrode of the heat generating member, and the second pattern and said another electrode of the heat generating member are connected via through-holes.

9. The heater of claim 1, further comprising:

a temperature adjusting element configured to adjust the temperature of the heater; and another wiring pattern for the temperature adjusting element in the second layer.

10. The heater of claim 1, further comprising:

a protective layer that covers the heat generating member.

11. A heating apparatus comprising:

an endless belt;

a heater opposed to a conveyed sheet via the endless belt; and a body set in a position opposed to the heater across the endless belt, wherein the heater comprises:

a heat generating member in a first layer, a sensor that is in a second layer different from the first layer and configured to detect a temperature of the heat generating member, and a wiring pattern in one or more third layers between the first and second layers to supply power to the heat generating member.

12. The heating apparatus of claim 11, wherein the heater further comprises another wiring pattern to supply power to the sensor.

13. The heating apparatus of claim 12, wherein said another wiring pattern is included in a layer other than the third layers.

14. The heating apparatus of claim 11, wherein the heat generating member extends along a longitudinal direction of the heater.

15. The heating apparatus of claim 11, wherein the wiring pattern comprises:

a first pattern electrically connected to one electrode of the heat generating member, and a second pattern electrically connected to another electrode of the heat generating member.

16. The heating apparatus of claim 15, wherein the first and second patterns are included in different layers.

17. The heating apparatus of claim 15, wherein the wiring pattern further comprises a third pattern electrically connected to an electrode of another heat generating member, and the first and third patterns are included in different layers.

18. The heating apparatus of claim 15, wherein the first pattern and said one electrode of the heat generating member, and the second pattern and said another electrode of the heat generating member are connected via through-holes.

19. The heating apparatus of claim 11, wherein the heater further comprises:

a temperature adjusting element configured to adjust the temperature of the heater, and another wiring pattern for the temperature adjusting element in the second layer.

20. The heating apparatus of claim 11, wherein the heater further comprises a protective layer that covers the heat generating member.

* * * * *